United States Patent [19]

Pelz

[11] 4,130,282

[45] Dec. 19, 1978

[54] GOLF PUTTING SYSTEM FOR PLAY AND PRACTICE

[76] Inventor: David T. Pelz, 13129 Oriole Dr., Beltsville, Md. 20705

[21] Appl. No.: 799,431

[22] Filed: May 23, 1977

Related U.S. Application Data

[63] Continuation-in-part of Ser. No. 580,243, May 23, 1975, Pat. No. 4,025,078.

[51] Int. Cl.[2] ..... A63B 69/36

[52] U.S. Cl. ..... 273/186 A; 273/168; 273/171; 273/194 A

[58] Field of Search ..... 273/186 A, 194 A, 194 B, 273/194 R, 162 R, 163 R, 164, 168, 171, 172, 26 B, 29 A

[56] References Cited

U.S. PATENT DOCUMENTS

| | | | |
|---|---|---|---|
| 2,503,506 | 4/1950 | Miller | 273/194 A X |
| 3,039,776 | 6/1962 | Faini | 273/194 A X |
| 3,194,564 | 7/1965 | Swan | 273/186 A |
| 3,912,277 | 10/1975 | Pelz | 273/186 A |
| 4,025,078 | 5/1977 | Pelz | 273/186 A |

*Primary Examiner*—George J. Marlo
*Attorney, Agent, or Firm*—Nicholas J. Aquilino

[57] ABSTRACT

A putting system for practicing and playing golf whereby a golfer is able to use the same putter in both a practice and playing mode. The club is adapted to be used with two interchangeable attachments. A first attachment provides spaced elements which are positioned on the striking face of the club to restrict the effective hitting area around the center of percussion of the club. The second attachment is interchangeable with the first and leaves the striking face of the club unobstructed while maintaining the same mass and weight characteristic to the club.

6 Claims, 6 Drawing Figures

GOLF PUTTING SYSTEM FOR PLAY AND PRACTICE

REFERENCE TO RELATED APPLICATION

This application is a continuation in part of U.S. Ser. No. 580,243, filed May 23, 1975, for Attachment for a Golf Club, now U.S. Pat. No. 4,025,078.

BACKGROUND OF THE INVENTION

The present invention relates to a golf club putting system which provides a player with the opportunity to use a golf club as both a practice and playing device. More particularly, the invention is directed to golf club adapted to be fit onto a putter to restrict the striking face on the putter for the purpose of teaching the player to strike a golf ball within the restricted area on the striking face and adapted to be fitted with a playing attachment so the same club may be used in playing a game of golf.

Prior art golf practice devices designed for putting are awkward in nature and present a practice device which is substantially different in weight, feel and appearance from a normal club designed for playing golf. For example, one publication shows a putter having a pair of pins which project a substantial distance in front of the striking face of the putter for the purpose of providing an elongated channel into which the ball to the struck must fit. Another publication shows a bumper arrangement which must be clamped to a conventional putter and which is substantial in size and weight thereby changing the basic nature of the putter club.

The prior Pelz U.S. Pat. No. 3,912,277 shows a golf club having a single attachment which is used in alternate positions on the club head in both a practice and playing mode.

SUMMARY OF THE INVENTION

The present invention relates to a putting system using an attachment for a golf club designed to be used as a practice device whereby, when it is attached to a golf club in a practice mode, restricts the area on the striking face of the club where a ball may be properly struck.

The system is designed to accommodate a second attachment which is mounted away from the striking face, or to be completely removed from the club head, when the club is being used to play golf.

Among the objects of the invention are the provision of a golf putting system including a putter-type golf club using two attachments so the club may be used in both a practice and playing mode, the provision of a putting system using a club and a practice attachment which may be used as a practice device to teach a player to strike a golf ball on the effective center of percussion of the club striking face, the provision of a golf club having a playing attachment which may be used on a club in playing position thereby maintaining essentially the same characteristics as the club had in the practice mode.

DESCRIPTION OF THE PREFERRED EMBODIMENT

Figure 1:
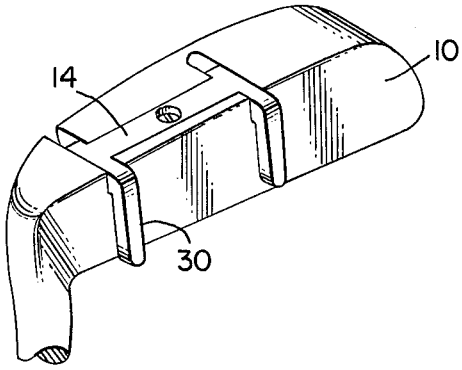
FIG. 1 is a perspective view of a golf club showing an attachment in place in the practice mode.
Figure 2:
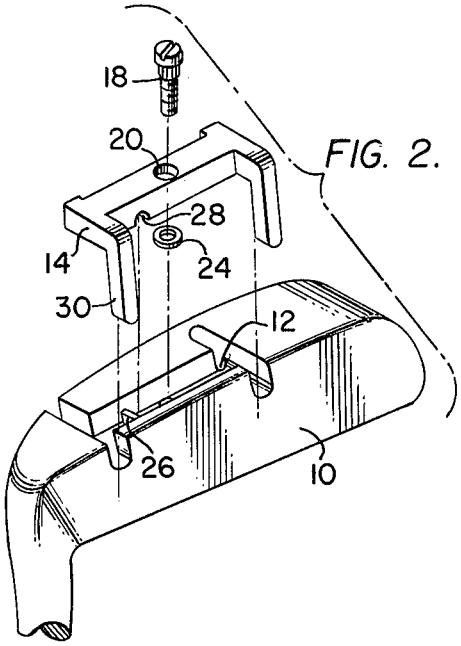
FIG. 2 is an exploded view of FIG. 1.
Figure 3:
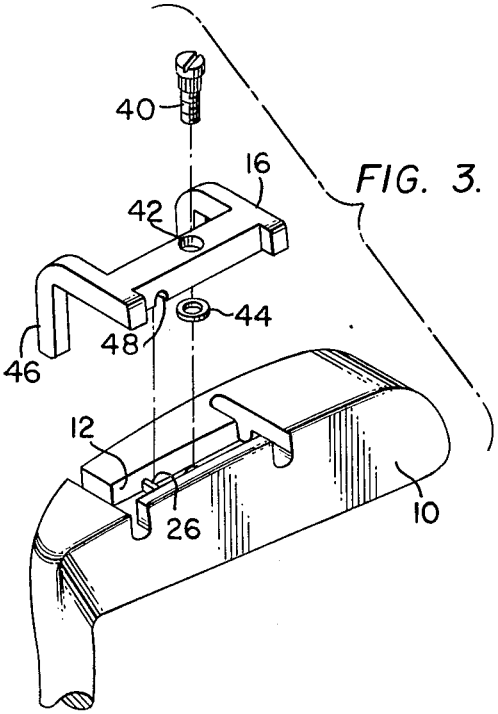
FIG. 3 is an exploded view of a golf club showing an attachment in place in the playing mode.
Figure 4:
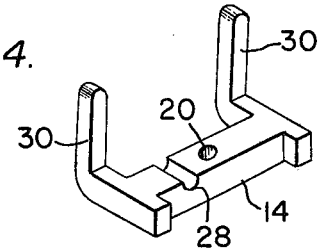
FIG. 4 is a perspective view of a practice attachment.
Figure 5:
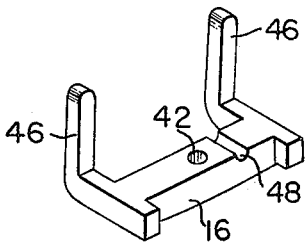
FIG. 5 is a perspective view of a playing attachment.
Figure 6:
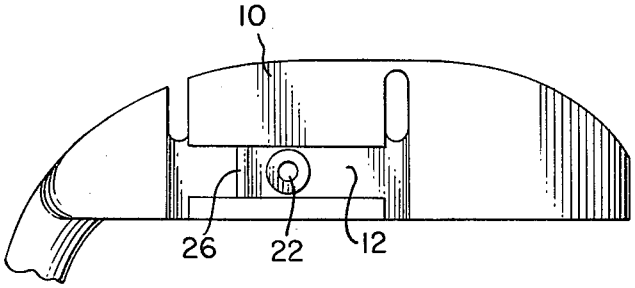
FIG. 6 is a bottom view of a golf club showing a recess for the attachments.

The putting system of the present invention is seen with reference to the drawings. A golf putter 10 is provided with a recess 12 which is adapted to accommodate an attachment. FIGS. 1 and 2 show the putter 10 with a practice attachment 14 in the cavity 12, whereas FIG. 3 shows a putter 10 using a playing attachment 16 in place in the recess 12. The practice attachment 14 includes a pair of upstanding spaced elements 30 and is provided with a suitable threaded screw 18 which passes through a hole 20 in the attachment and is secured in a threaded hole 22 in the recess 12 of the putter 10. The screw 18 is held in place in the attachment by a suitable lock washer 24 or the like.

The recess 12 in the putter 10 is provided with a raised alignment bar 26 which projects above the bottom of the recess. The practice attachment 14 is provided with a cavity 28 which is adapted to receive the bar 26 in the recess 12 when the attachment is in place in the putter. The practice attachment 14 has its cavity 28 on one side of the center line of the attachment.

With this arrangement, the practice attachment 14 can be correctly seated in the recess 12 of the clubhead 10 only when the bar 26 aligns with the cavity 28 on the attachment 14. In this position, the elements 30 project in front of the face of the clubhead forming a restricted area where a golf ball may be struck without interference from one of the elements 30.

A playing attachment 16 is made similar to the practice attachment 14 and includes a threaded screw 40, a hole 42 to receive the screw 40 and a lock washer 44. The playing attachment 16 also includes a pair of upstanding spaced elements 46. The playing attachment 16 includes a cavity 48 which also is adapted to receive the bar 26 in the recess 12 in the clubhead 10. This cavity 48 is similar to the cavity 28 of the practice attachment 14 except it is located on the opposite side of the center of the attachment 16 with respect to the elements 46. Therefore, when the playing attachment 16 is properly positioned within the recess 12 of the clubhead, the elements 46 project rearwardly of the putter striking face to provide an unobstructed striking face.

The operation of the present invention will be more clearly understood by reference to copending Ser. No. 580,243 filed May 23, 1975 now U.S. Pat. No. 4,025,078 and Ser. No. 490,909 filed July 22, 1974 for Golf Club, now U.S. Pat. No. 3,912,277.

With the practice attachment 14 in position on the putter 10, the area directly around the effective center of percussion where a golf ball may be struck to project it on a straight path is greatly reduced by the presence of the spaced elements 30. In use, unless a ball is struck on or near the center of percussion, it will hit one of the spaced elements 30 causing it to deviate substantially from its normal path. This provides an immediate indication of an improper stroke and by repeated use, a golfer can train himself to strike the ball on or near the center of percussion which achieves more consistent putting results.

The putting system of the present invention provides a playing attachment 16 which is essentially the same as the practice attachment except that it fits in the putter in an opposite way so that the spaced elements project to the rear of the putter striking face while still maintaining the same mass and weight characteristics of the putter when it was used for practice.

Thus, the putting system provides a golf club which can be used equally well in a playing or practice mode depending upon which attachment is used without deterring the essential characteristics of the club. It will be appreciated any shape golf club head is applicable to the present invention and that the particular blade type putter is exemplary only.

Inasmuch as the present invention is subject to many variations, modifications and changes in detail, it is intended that all subject matter discussed above or shown in the accompanying drawings be interpreted as illustrative and not in a limiting sense.

What is claimed is:

1. A putting system for practicing and playing golf whereby a golfer is able to use the same golf club for both practice and playing wherein the improvement comprises a clubhead including a ball striking face, a first attachment adapted to be attached to said clubhead, a second attachment adapted to be attached to said clubhead, means for receiving one of said attachments including locating means for locating one of said attachments at said receiving means, said first attachment adapted for use in the practice mode and including spaced elements at the ends of said attachment and projecting outwardly from said attachment, and first positioning means offset from and non-symetrical with the center of said first attachment, said first positioning means cooperating with said locating means for positioning said first attachment with respect to said receiving means whereby said spaced elements are positioned forwardly of said ball striking face to form a restricted area on said ball striking face for striking a golf ball, said second attachment adapted for use in the playing mode including second positioning means offset from and non-symetrical with the center of said second attachment cooperating with said locating means for positioning said second attachment with respect to said receiving means to provide an unobstructed surface on said ball striking face for striking a golf ball.

2. The system of claim 1 wherein said second attachment includes spaced elements at the ends of said second attachment and projecting outwardly therefrom, whereby said elements are positioned away from said ball striking face when said second attachment is positioned using said second positioning means in cooperation with said locating means.

3. The system of claim 2 wherein said first means includes a recess in said clubhead for receiving one of said attachments.

4. The system of claim 3 wherein said first positioning means on said first attachment is a first cavity which mates with said locating means whereby said locating means is disposed in said first cavity when said first attachment is properly positioned.

5. The system of claim 4 wherein said second positioning means on said second attachment is a second cavity which mates with said locating means whereby said locating means is disposed in said second cavity when said second attachment is properly positioned.

6. The system of claim 3 wherein said locating means includes an alignment bar disposed on the lower surface of said recess.

* * * * *